US008237623B2

(12) United States Patent
Hung

(10) Patent No.: US 8,237,623 B2
(45) Date of Patent: Aug. 7, 2012

(54) HEADSET ANTENNA AND CONNECTOR FOR THE SAME

(75) Inventor: Chung-Ting Hung, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 676 days.

(21) Appl. No.: 12/036,276

(22) Filed: Feb. 24, 2008

(65) Prior Publication Data

US 2009/0033574 A1 Feb. 5, 2009

(30) Foreign Application Priority Data

Jul. 30, 2007 (TW) ..... 96127761 A

(51) Int. Cl.
*H01Q 1/50* (2006.01)

(52) U.S. Cl. ..... 343/906; 343/718; 343/702; 343/860; 381/384

(58) Field of Classification Search ..... 343/718, 343/720, 905, 906, 702, 787, 860; 381/384
See application file for complete search history.

(56) References Cited

U.S. PATENT DOCUMENTS

| | | | | |
|---|---|---|---|---|
| 7,373,169 | B2 * | 5/2008 | Yoshino | 455/550.1 |
| 7,532,718 | B2 * | 5/2009 | Cohen et al. | 379/430 |
| 7,840,242 | B2 * | 11/2010 | Yoshino | 455/575.2 |
| 2005/0094840 | A1 * | 5/2005 | Harano | 381/381 |
| 2006/0028383 | A1 * | 2/2006 | Yoshino | 343/718 |
| 2007/0105438 | A1 * | 5/2007 | Yoshino | 439/578 |
| 2007/0194998 | A1 * | 8/2007 | Miyagi et al. | 343/702 |
| 2009/0015505 | A1 * | 1/2009 | Nagano et al. | 343/850 |

FOREIGN PATENT DOCUMENTS

| | | | |
|---|---|---|---|
| CN | 1612411 | | 5/2005 |
| CN | 1707854 | | 12/2005 |
| JP | 2007173980 | A * | 7/2007 |
| WO | WO 2006082683 | A1 * | 8/2006 |

OTHER PUBLICATIONS

"First Office Action of China Counterpart Application", issued on Aug. 31, 2011, p. 1-7, in which the listed reference was cited.
"First Office Action of China Counterpart Application", issued on Aug. 31, 2011, with English translation thereof, p. 1-7.
"Second Office Action of China Counterpart Application" with English translation thereof, issued on Mar. 22, 2012, p. 1-11, in which the listed reference was cited.

* cited by examiner

*Primary Examiner* — Dieu H Duong
(74) *Attorney, Agent, or Firm* — Jianq Chyun IP Office

(57) ABSTRACT

A headset antenna and a connector for the same are provided. The headset antenna includes an audio signal line, an antenna and a high impedance element in specified application frequency ranges. The audio signal line is adapted for transmitting an audio signal and the antenna is adapted for receiving an RF signal. The high impedance element is disposed on a transmission path of the audio signal and generates a high impedance at a specified frequency band of the RF signal, so that the audio signal line is equivalent to an open circuit and the antenna obtains a better receiving capability.

12 Claims, 5 Drawing Sheets

HEADSET ANTENNA AND CONNECTOR FOR THE SAME

CROSS-REFERENCE TO RELATED APPLICATION

This application claims the priority benefit of Taiwan application serial no. 96127761, filed on Jul. 30, 2007. The entirety of the above-mentioned patent application is hereby incorporated by reference herein and made a part of this specification.

BACKGROUND OF THE INVENTION

1. Field of the Invention

The present invention generally relates to a circuit structural design for an antenna, and more particularly to a circuit structural design for a headset antenna.

2. Description of Related Art

Headset antennas are widely used in mobile broadcast, especially in receiving operation of frequency modulation (FM) broadcast. Currently, headset antennas are also employed in mobile television field for improving signal receiving efficiency thereof.

In a typical headset antenna, an audio signal line and an antenna are often integrated in a headset wire. Therefore, signals received by the antenna attenuate due to a coupling effect of adjacent lines. That is so because, the audio signal line is equal to a ground at the specified frequency band of the RF (Radio frequency) signal, so that receiving capability of the antenna is weakened due to the adjacent audio signal lines. This is also a main factor restricting the receiving capability of the current conventional headset antennas. However, most current headset antennas are designed to improve the receiving capability by employing post power amplifiers, instead of providing a corresponding solution.

SUMMARY OF THE INVENTION

Accordingly, the present invention is directed to a mobile phone antenna, in which a high impedance element is disposed on a transmission path of an audio signal. The high impedance element is adapted to selectively increase equivalent impedance at a specified frequency band of the antenna. Therefore, the audio signal lines are equal to an open circuit at the specified frequency band of RF signals received by the antenna, and receiving capability of the antenna is improved.

The present invention provides a connector for an electronic device. There is a high impedance element disposed at a transmitting pin of audio signals so as to avoid a loss of the receiving capability of the antenna caused by circuit coupling.

The present invention provides a headset antenna. The headset antenna includes at least an audio signal line, an antenna and at least one high impedance element. The audio signal line is adapted for transmitting an audio signal. The antenna is disposed adjacent to the audio signal line and is adapted for receiving an RF signal. The high impedance element is correspondingly disposed on a transmission path of the audio signal line. The audio signal and the RF signal are transmitted at different specified frequency bands, and equivalent impedance generated by the high impedance element at the specified frequency band of the RF signal is greater than that generated at specified frequency band of the audio signal.

According to an embodiment of the present invention, the foregoing headset antenna further includes a connector. The connector includes an audio pin, an antenna pin. The audio pin is coupled with the audio signal line and the antenna pin is coupled with the antenna, wherein the high impedance element integrated on a board of the connector.

According to an embodiment of the present invention, the foregoing specified frequency band of the RF signal includes a frequency modulation broadcast band, i.e., 87 MHz to 108 MHz.

According to an embodiment of the present invention, the foregoing specified frequency band of the RF signal includes a band from 300 MHz to 3 GHz.

According to an embodiment of the present invention, the foregoing specified frequency band of the audio signal includes a band from 20 Hz to 20 KHz.

According to an embodiment of the present invention, the foregoing audio signal lines include a right sound channel signal line, a left sound channel signal line, and a microphone audio signal line.

According to an embodiment of the present invention, the foregoing headset antenna further includes a ground line for applying a ground level to the audio signal and there is a high impedance element disposed on a transmission path of the ground line.

According to an embodiment of the present invention, the foregoing high impedance element is a magnetic bead, an electrical inductor, an iron core, or a resistor.

According to an embodiment of the present invention, the headset antenna further comprises a plurality of data signal lines for transmitting a plurality of data signals and a plurality of second high impedance elements are respectively disposed on transmission paths of the data signal lines.

The present invention further provides an electronic device connector adapted for a headset antenna. The connector includes an audio pin, an antenna pin and a high impedance element. The audio pin is used for transmitting the audio signal to the headset. The antenna pin is used for receiving an RF signal received from the headset antenna. The high impedance element is disposed at a rear of the audio pin.

The present invention disposes a high impedance element on a transmission path of an audio signal, an impedance of the high impedance element varying corresponding to the frequency. In such a way, the high impedance element is capable of selectively generating a greater equivalent impedance in the specified frequency band of an RF signal received by the antenna. As such, the audio line is regarded as an open circuit at the specified frequency band of the RF signal and as a short circuit at the specified frequency band of the audio signal, so that the audio signal can be well transmitted thereby. When the antenna receives an RF signal, the high impedance element that is equivalent to a high impedance element is capable of decreasing the coupling between the RF signal and the adjacent audio signal line, so as to improve the receiving capability of the antenna.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
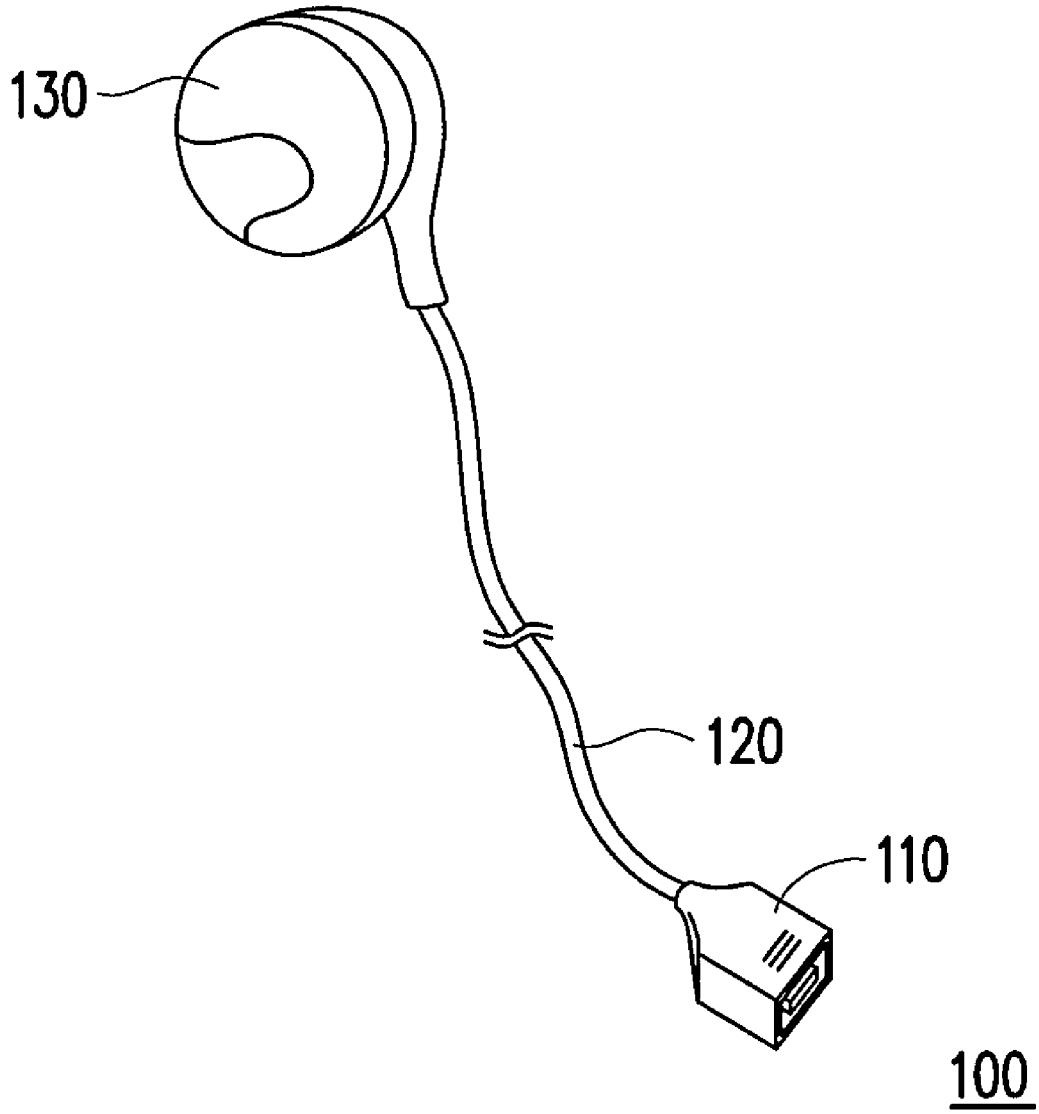
FIG. 1 illustrates a headset antenna according to a first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

First Embodiment

FIG. 1 illustrates a headset antenna according to a first embodiment of the present invention. Referring to FIG. 1, the headset antenna 100 includes a connector 110, a headset wire 120 and a speaker 130. The headset wire 120 may include a ground line for left/right sound channels, an audio signal line of a left sound channel, an audio signal line of a right sound channel, an audio signal line of a microphone, and an antenna. According to different types of products, the headset wire 120 may selectively integrates the audio signal lines of the left sound channel and the right sound channel, and the audio signal line of the microphone, or even more signal transmission lines, e.g., a signal line for controlling a volume adjustment. According to an aspect of the first embodiment, the headset wire 120 is exemplified as including a ground line for left/right sound channels, an audio signal line of the left sound channel, an audio signal line of the right sound channel, an audio signal line of the microphone, and an antenna.

However, types and pieces of signal lines integrated in the headset wire 120 are not restricted according to the present invention. Even only one signal line, e.g., a audio signal line integrated with the antenna line, is still adapted for being applied with the instant embodiment of the present invention. Furthermore, according to another embodiment of the present invention, the aforementioned antenna can be served as a ground line for the microphone, for providing a grounding level of the audio signal thereof.

The connector 110 can be a male connector or a female connector, which can be of a type selected from the group consisting of a universal serial bus (USB), mini-USB, radio corporation of America (RCA), Jack plug, XLR, DIN, MINI-DIN, BNC, DB25, Speakon, and TosLink. The connector 110 is adapted for different electronic devices, and the specifications and design of structure of the connector 110 are not limited in the present embodiment.

The headset wire 120 at least includes an antenna, and an audio signal line which is disposed adjacent to the antenna. If a signal received by the antenna is a radio frequency (RF) signal, and a signal received by other audio signal line(s) is an audio signal, a specified frequency band of the RF signal is higher than a specified frequency band of the audio signal. When the antenna receives the RF signal, the RF signal will be attenuated because of adjacent audio signal line(s) or other adjacent data transmission lines. It is so because the audio signal lines is equal to a ground at the specified frequency band of the RF (Radio frequency) signal, so that receiving capability and power of the antenna is reduced due to the coupling effect between the antenna and the adjacent audio signal lines.

Therefore, in the present embodiment, an equivalent impedance generated by the audio signal line at the specified frequency band of the RF signal is greater than that generated at the specified frequency band of the audio signal. When the equivalent impedance generated by the audio signal line at the specified frequency band of the RF signal is much greater than equivalent impedances generated by other ordinary transmission lines, the audio signal line is equal to an open circuit at the specified frequency band of the RF signal. In such a way, the receiving capability of the antenna can be effectively improved.

Further, in this embodiment, a high impedance element, such as a magnetic bead, an electrical inductor, an iron core, or a resistor, is disposed on a transmission path of the audio signal, i.e., the audio signal line or a rear of the connector connecting the audio signal line, for improving the receiving capability of the antenna. All of the foregoing high impedance elements vary impedance thereof corresponding to change of frequency. As such, the high impedance elements can be designed to generate different equivalent impedances in different frequency bands. Therefore in the current embodiment, the high impedance element is adapted to generate higher impedance at the specified frequency band of the antenna, so that the audio signal line can be equivalent to an open circuit in the specified frequency band of the antenna.

The RF signal and the audio signal line respectively correspond to different specified frequency bands. For example, in the current embodiment, the RF signal frequency received by the antenna is in a broadcast band from 87 MHz to 108 MHz, or an ultra high frequency (UHF) band from 300 MHz to 3 GHz, both of which are higher than a frequency of the audio signal transmitted by the audio signal line, e.g., about 20 Hz to 20 KHz. In the present embodiment, the equivalent impedance generated by the high impedance element at the specified frequency band of the RF signal is greater than that generated at the specified frequency band of the audio signal. Therefore, when the antenna receives the RF signal, the high impedance element which is equivalent to a high impedance causes the adjacent audio signal line equivalent to an open circuit so as to improve receiving capability of the antenna.

As discussed above, many types can be selected as the high impedance element. Taking an inductor as an example, a higher frequency means a higher equivalent impedance thereof, so that when a suitable inductance is set, the desired open circuit effect can be achieved. Taking a magnetic bead as an example, it can obtain a high impedance in a specified frequency band, and thus can achieve similar open circuit effect. Further, according to another embodiment of the present invention, other circuits, such as a wave filter can also be used for frequency selection, which should be well known to those of ordinary skill in the art by referring to the teachings of the present invention, and would be iterated hereby. Hence, a detailed description thereof is omitted.

Figure 2A:
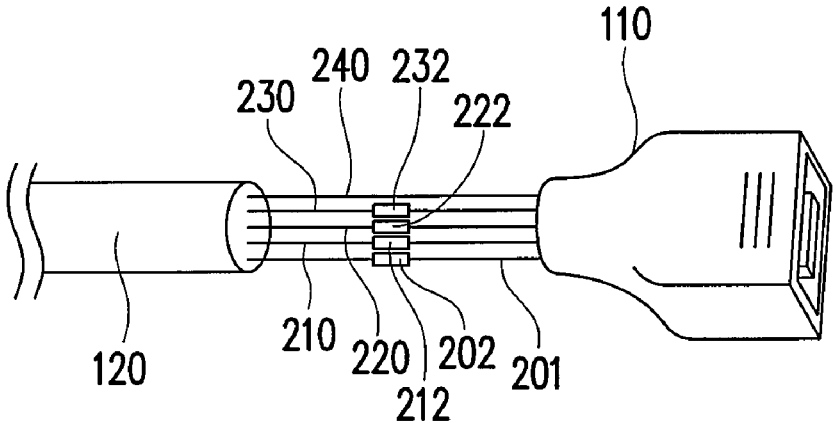
FIG. 2A is a layout diagram of a high impedance element according to the first embodiment of the present invention.

The high impedance element according to the current embodiment is disposed on the transmission path of the audio signal. In details, the high impedance element can be disposed as shown in FIG. 2A according to an aspect of the first embodiment, on the audio signal line. As shown in FIG. 2A, the headset 120 includes a ground line for left/right sound channels 201, an audio signal line 210 for the left sound channel, an audio signal line 220 for the right sound channel, an audio signal line 230 for the microphone, and an antenna 240. The high impedance elements 202, 212, 222, 232 are disposed respectively on the ground line 201 and the audio signal line 210, 220, 230. The high impedance elements are adapted to be disposed on any audio signal lines and ground lines other than the antenna 240, so as to lower the attenuation of the RF signal, and thus improve the receiving capability of the antenna 240.

Furthermore, the high impedance elements may also be selectively disposed on those audio signal lines which are more adjacent to the antenna 240, rather than disposed on each of the audio signal lines. As such, similar result of lowering the attenuation of the RF signal can be achieved while saving production cost corresponding to the high impedance elements.

Second Embodiment

Figure 2B:
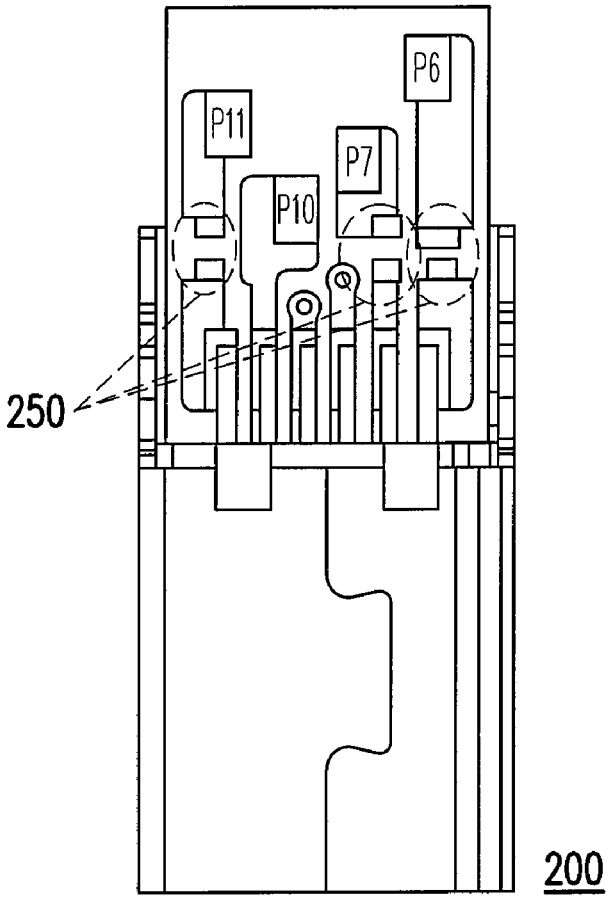
FIG. 2B is a structure diagram illustrating a connector according to a second embodiment of the present invention.

In another concern, the high impedance element can also be disposed on a board of the connector 110 as shown in FIG. 2B. FIG. 2B is a structural diagram illustrating a connector according to a second embodiment of the present invention. Referring to FIG. 2B, there is illustrated a contact portion 200 of the connector. The audio pin P6 is adapted for transmitting an audio signal of the microphone. The audio pin P7 is adapted for transmitting an audio signal of the right sound channel. The audio pin P11 is adapted for transmitting an audio signal of the left sound channel. The antenna pin P10 is adapted for transmitting the RF signal received from the antenna.

The high impedance elements can be disposed on the rears of respectively the audio pins P6, P7, P11 and directly integrated to the designed position 250 on the board of the connector. In an integrating process, the high impedance elements can be integrated to the substrate by a low temperature co-fired ceramic (LTCC) technology, or be individually welded on to a printed circuit board (PCB). It should be noted that there is no high impedance element disposed on a conductance path of the antenna pin P10, which is necessary for maintaining a regular conductance of the antenna.

There are many kinds of connectors with different structures can be selected for the present invention, and the present invention is only exemplified with FIG. 2B. Similar connector structures, e.g., USB, can also be used in accordance with the foregoing embodiments, in which the high impedance elements are disposed at rears of contact pins except the antenna pin or on the transmission paths of the audio signals for improving the receiving capability of the antenna.

Figure 2C:
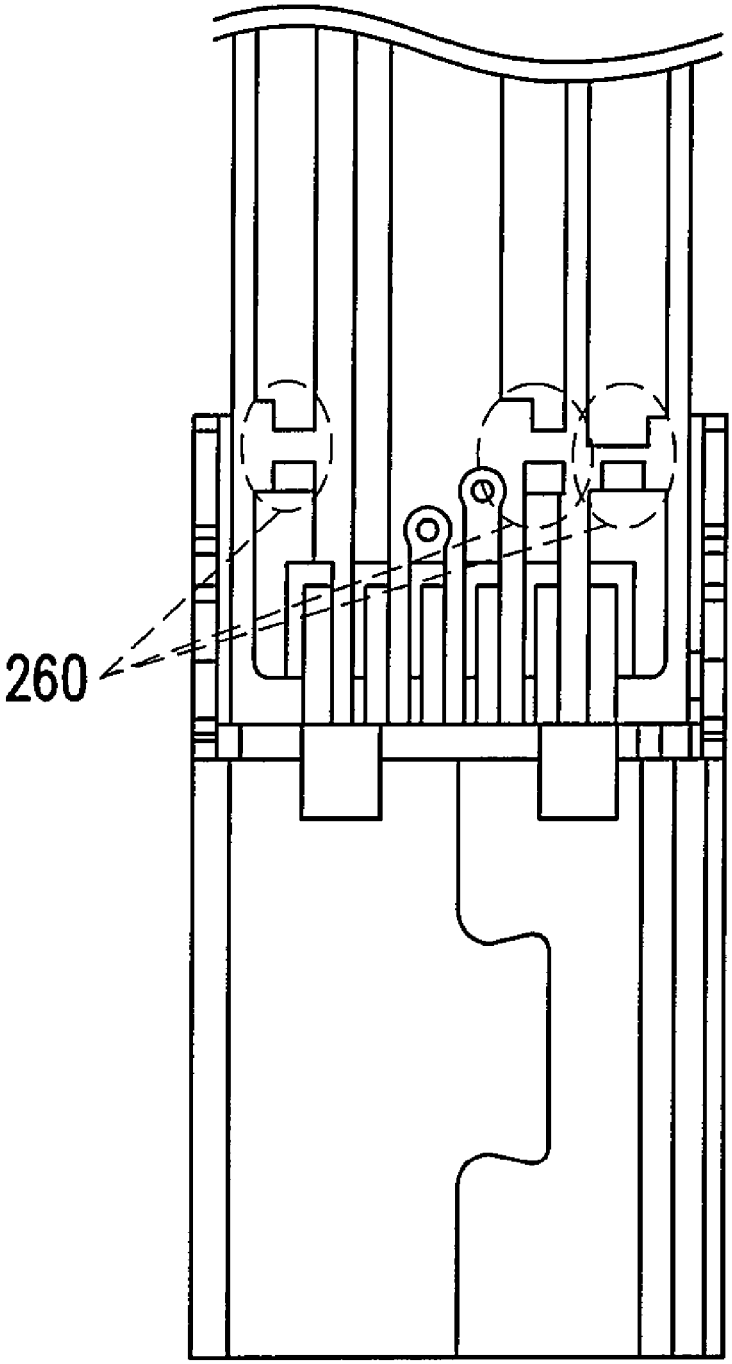
FIG. 2C is a structure diagram illustrating a connector in an electronic device according to the second embodiment of the present invention.

According to another embodiment of the present invention, the high impedance element can also be disposed in the electronic device, as configured as shown in FIG. 2C. The structure shown in FIG. 2C is different from FIG. 2B about the structure of the pins. When the electronic device does not require pin structures, the high impedance elements can be directly disposed on metal wires of the PCB board as described at position 260 shown in FIG. 2C. In the electronic device, the high impedance elements can be directly disposed on the transmission path of the audio signal. When the antenna receives the RF signal, the signal transmission path for transmitting audio signals is equivalent as an open circuit at the specified frequency band of the RF signal, so as to improve the receiving capability of the antenna.

Furthermore, if the headset antenna needs to incorporate other functions such as signal transmittance or data transmittance, e.g., volume controlling, corresponding transmission paths are then required in addition. Similarly, whatever the transmission lines may be added, each of them can be configured with a high impedance element according to the spirit of the present invention, unless it is an antenna. However, it is to be noted that each high impedance element can be complied with different types or different models of elements. If only there is disposed a high impedance element on each of the transmission paths of the signal lines other than the antenna, i.e., the ground line for left/right sound channels, and the audio signal lines of the left sound channel, the right sound channel and the microphone, and the data transmission line, the signal lines other that the antenna are all equivalent as open circuits at the specified frequency band of the RF signal and would not affect receiving capability of the antenna.

Figure 3:
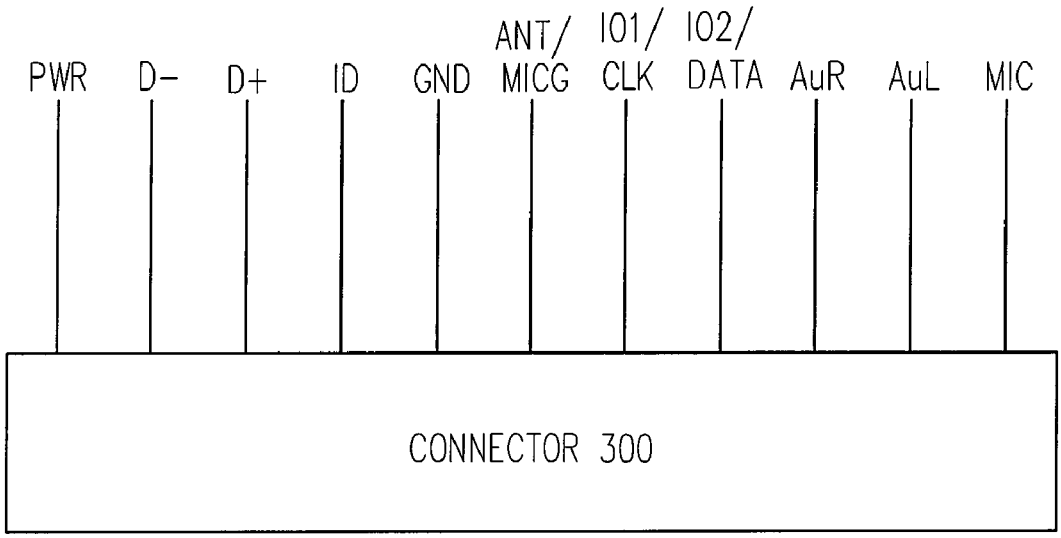
FIG. 3 is a signal transmittance diagram of the connector according to the second embodiment of the present invention.

Herebelow, the embodiment combined with a connector is illustrated in enumerating several signal lines or data modes which may probably be integrated to the headset antenna. FIG. 3 is a signal transmittance diagram of the connector according to the second embodiment of the present invention. Referring to FIG. 3, the connector 300 includes 11 pins, respectively responsible for transmitting signals or data of different types, including microphone signal (MIC), left sound channel audio signal (AuL), right sound channel audio signal (AuR), data (IO2/DADA), clock (IO1/CLK), FM antenna also served as a ground line of the microphone (ANT/ICG), ground line (GND), device identification data (ID), data anode (D+), data cathode (D−), and power source (PWR). If the headset antenna is adapted for connection with the above-described connector 300 having 11 pins, the corresponding audio transmission paths, signal lines and ground lines can be applied with the present invention as disclosed above to dispose high impedance elements thereon.

Positions of disposing the high impedance elements are transmission paths of the audio signals or data signals or rears of the pins of a board of the connector 300, as shown in FIGS. 2A and 2B. Furthermore, it should be noted that the present invention is not exclusively adapted for headset antenna. Any circuit or line incorporating with an antenna is suitable for the present invention for improving the receiving capability of the antenna.

Third Embodiment

Figure 4:
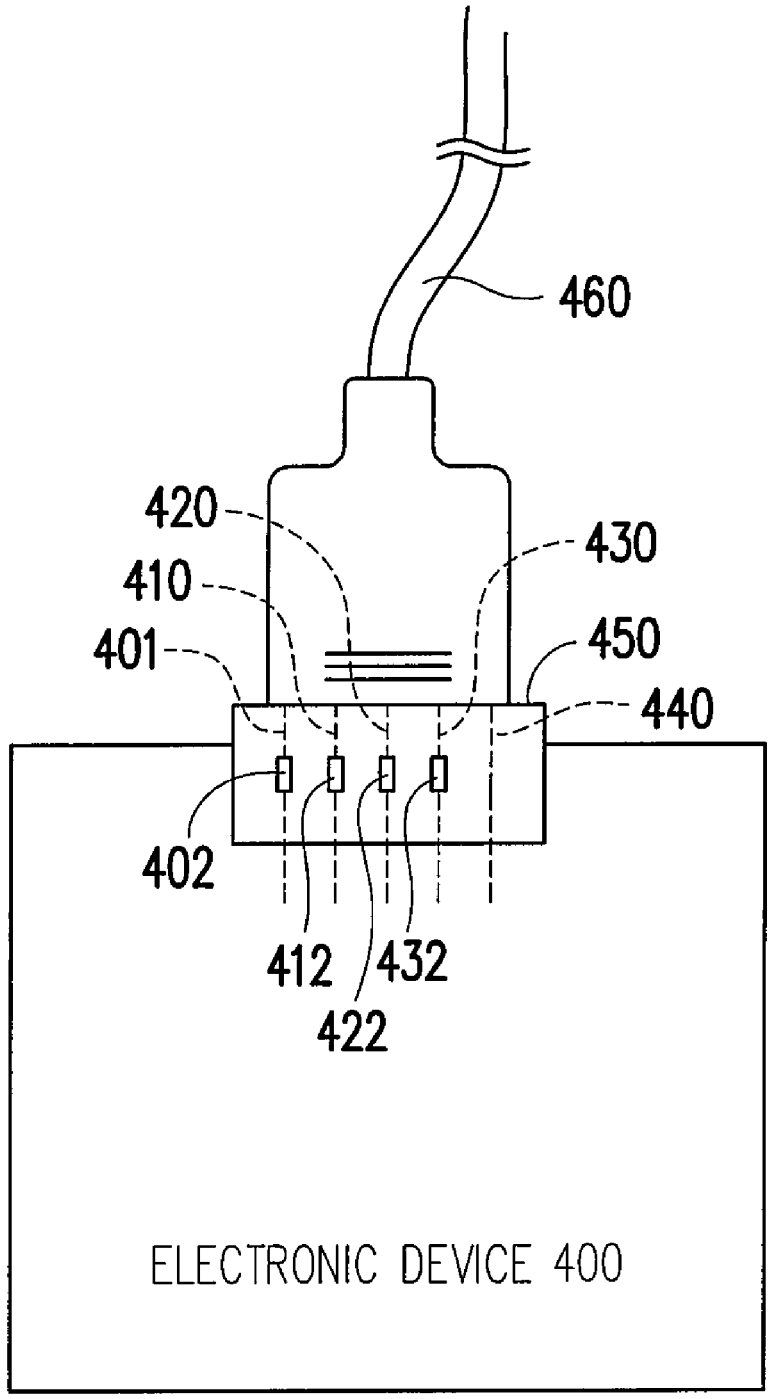
FIG. 4 is a schematic structure diagram illustrating an electronic device and a connector thereof according to a third embodiment of the present invention.

FIG. 4 is a schematic structural diagram illustrating an electronic device and a connector thereof according to a third embodiment of the present invention. Referring to FIG. 4, the electronic device 400 includes a connector 450. The connector 450 includes pins 401, 410, 420, 430, 440. The pin 401 for example is a ground pin for grounding left and right sound channels corresponding to ground levels of the audio signals thereof. The pins 410 and 420 are for example audio pins of respectively the left and right sound channels for transmitting audio signals to the headset antenna 460. The pin 430 for example is a microphone audio pin for transmitting audio signals of the microphone. The pin 440 for example is an antenna pin, for transmitting RF signals received by the headset antenna 460. The headset antenna 460 is coupled to the electronic device 400 via the connector 450.

Each of high impedance elements 402, 412, 422, 432 is disposed at a rear of the pins 401, 410, 420, 430 respectively on a board of the connector 450. Therefore, when the electronic device 400 receives an RF signal via the headset antenna 460, the pins 401, 410, 420, 430 are equivalent as open circuits at the specified frequency of the RF signal, so as to lower the disturbance to the RF signal. Further, the quantity of the pins in the connector 450 is not restricted as exemplified in the current embodiment, and transmittance pins of other signal lines can also be incorporated as shown in FIG. 3. Only if the high impedance elements are disposed on rears of the pins other than the antenna pin, the receiving capability of the antenna can be improved.

When a signal line, e.g., an audio signal line, has a high impedance element disposed on the transmission path thereof, it selectively generates a relatively large equivalent impedance at a receiving frequency band of the antenna, so as to reduce a coupling effect between the antenna and the adjacent signal lines. When an adjacent signal line generates a relatively large equivalent impedance at the specified frequency band of the antenna, it is equivalent to an open circuit regarding to the RF signal transmitted by the antenna. As such, the RF signal would not be directly coupled to adjacent signals, so as to improve the receiving capability of the antenna. The High impedance elements are disposed on the transmission paths of the signals, for example, the board of the connector 450, where the electronic device 400 couples with the connector 450, or the substrate of the electronic device 400. Exact positions where the high impedance elements are disposed are not to be further limited according to the present invention.

In summary, the present invention disposes a high impedance element on a transmission path of an audio signal. Because the frequency band of the antenna is different from that of the audio lines, when the antenna receives an RF signal, the high impedance element that is equivalent to a high impedance element is capable of decreasing the coupling effect between the RF signal and the adjacent audio signal line, so as to improve the receiving capability of the antenna.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A headset antenna comprising:

a headset, comprising a speaker;

a connector, electrically connected to the speaker through a headset wire;

at least an audio signal line, extended between the speaker and the connector and incorporated in the headset wire, for transmitting an audio signal in a first frequency band;

an antenna, incorporated in the headset wire, wherein the antenna is extended from the speaker to the connector continuously without any high impedance element therein and is capable of receiving an RF signal in a second frequency band different from the first frequency band; and at least one first high impedance element, correspondingly disposed on a transmission path of the audio signal line, and not electrically connected to the antenna, wherein an equivalent impedance generated by the first high impedance element in the second frequency band is greater than that generated in the first frequency band.

2. The headset antenna of claim 1, wherein the connector comprises:

at least one audio pin, correspondingly coupled to the audio signal line; and an antenna pin, coupled to the antenna, wherein the first high impedance element integrated on a board of the connector.

3. The headset antenna of claim 1, wherein the second frequency band of the RF signal comprises a frequency modulation broadcast band.

4. The headset antenna of claim 3, wherein the frequency modulation broadcast band is from 87 MHz to 108 MHz.

5. The headset antenna of claim 1, wherein the second frequency band of the RF signal comprises a band from 300 MHz to 3 GHz.

6. The headset antenna of claim 1, wherein the first frequency band of the audio signal comprises a band from 20 Hz to 20 KHz.

7. The headset antenna of claim 1, wherein the audio signal line comprises a left sound channel signal line or a right sound channel signal line.

8. The headset antenna of claim 1, wherein the audio signal line comprises a microphone audio signal line.

9. The headset antenna of claim 1 further comprising;

a ground line, for applying a ground level to the audio signal; and a second high impedance element, disposed on a transmission path of the ground line.

10. The headset antenna of claim 9, wherein the second high impedance element is a magnetic bead, an electrical inductor, an iron core, or a resistor.

11. The headset antenna of claim 1, wherein the first high impedance element is a magnetic bead, an electrical inductor, an iron core, or a resistor.

12. The headset antenna of claim 1 further comprising:

a plurality of data signal lines, for transmitting a plurality of data signals; and a plurality of second high impedance elements, respectively disposed on transmission paths of the data signal lines.

* * * * *